US007721498B2

(12) United States Patent
Kang et al.

(10) Patent No.: US 7,721,498 B2
(45) Date of Patent: May 25, 2010

(54) FLOOR SYSTEM

(75) Inventors: Se-Chang Kang, Cheongju-si (KR); Dong-Sik Jang, Busan (KR); Myong Lee, Cheongju-si (KR); Seung-Min Jeon, Cheongju-si (KR); Sung-Seock Hwang, Cheongju-si (KR); Seong-Chan Park, Cheongju-si (KR)

(73) Assignee: LG Chem, Ltd. (KR)

( * ) Notice: Subject to any disclaimer, the term of this patent is extended or adjusted under 35 U.S.C. 154(b) by 0 days.

(21) Appl. No.: 11/520,235

(22) Filed: Sep. 13, 2006

(65) Prior Publication Data

US 2007/0056237 A1 Mar. 15, 2007

(30) Foreign Application Priority Data

Sep. 15, 2005 (KR) ..... 10-2005-0086185

(51) Int. Cl.

| | |
|---|---|
| ***E04B 1/74*** | (2006.01) |
| ***E04B 2/00*** | (2006.01) |
| ***E04F 13/08*** | (2006.01) |
| ***E04F 15/22*** | (2006.01) |

(52) U.S. Cl. ..... 52/428; 52/177; 52/408; 52/403.1; 52/404.1; 52/506.01

(58) Field of Classification Search ..... 52/177, 52/408, 403.1, 404.1, 428, 390, 506.01, 506.04; 428/218, 455; 248/633; 472/92
See application file for complete search history.

(56) References Cited

U.S. PATENT DOCUMENTS

| | | | | |
|---|---|---|---|---|
| 4,131,664 | A * | 12/1978 | Flowers et al. | 264/510 |
| 4,218,791 | A * | 8/1980 | Itoku | 5/284 |
| 4,637,184 | A * | 1/1987 | Radtke et al. | 52/220.4 |
| 4,644,720 | A * | 2/1987 | Schneider | 52/392 |
| 4,682,459 | A * | 7/1987 | Stephenson | 52/390 |
| 4,694,627 | A * | 9/1987 | Omholt | 52/390 |
| 4,852,315 | A * | 8/1989 | Fukayama | 52/220.3 |
| 4,884,932 | A * | 12/1989 | Meyer | 411/373 |
| 4,924,645 | A * | 5/1990 | Abeln | 52/177 |
| 4,967,529 | A * | 11/1990 | L'Heureux | 52/390 |
| 5,013,029 | A * | 5/1991 | Vaux | 404/32 |
| 5,116,439 | A * | 5/1992 | Raus | 156/71 |
| 5,497,590 | A * | 3/1996 | Counihan | 52/385 |
| 6,212,838 | B1 * | 4/2001 | Eda | 52/403.1 |
| 6,250,036 | B1 * | 6/2001 | Nurley et al. | 52/537 |
| 2002/0073640 | A1 * | 6/2002 | Virtanen | 52/390 |
| 2002/0081410 | A1 * | 6/2002 | Buckwalter et al. | 428/40.1 |
| 2004/0129365 | A1 * | 7/2004 | Buckwalter et al. | 156/71 |
| 2004/0154240 | A1 * | 8/2004 | Hiraguri et al. | 52/144 |
| 2005/0089678 | A1 * | 4/2005 | Mead | 428/323 |
| 2006/0032170 | A1 * | 2/2006 | Vershum et al. | 52/403.1 |
| 2006/0156663 | A1 * | 7/2006 | Mao | 52/403.1 |

FOREIGN PATENT DOCUMENTS

| | | |
|---|---|---|
| KR | 10-2004-0071641 | 8/2004 |

* cited by examiner

*Primary Examiner*—Richard E Chilcot, Jr.
*Assistant Examiner*—Mark R Wendell
(74) *Attorney, Agent, or Firm*—Cantor Colburn LLP

(57) ABSTRACT

Disclosed herein is a floor system for efficiently absorbing an impact applied to a floor. The floor system includes a first impact-absorbing material, and a second impact-absorbing material installed at an upper side of the first impact-absorbing material and having a higher density than that of the first impact-absorbing material.

9 Claims, 3 Drawing Sheets

FLOOR SYSTEM

This application claims the benefit of the filing date of Korean Patent Application No. 10-2005-0086185 filed on Sep. 15, 2005 in the Korean Intellectual Property Office, the disclosure of which is incorporated herein in its entirety by reference.

TECHNICAL FIELD

The present invention relates to a floor system, and more particularly, to a floor system for efficiently absorbing an impact applied to a floor.

BACKGROUND ART

Generally, houses provide an environment appropriate for human life, to serve as dwelling units for human beings. For this, the houses are provided with cooling/heating systems. A representative form of a dwelling in modern society is an apartment complex.

The apartment complex has a multi-floor structure in which a plurality of dwelling units are stacked in a vertical direction from the ground surface. Due to the particularity in that neighboring dwelling units jointly own floors and walls dividing them, the apartment complex has a necessity for a sound-insulating system capable of preventing transmission of noise between the dwelling sites, in addition to having cooling/heating systems.

A floor heating system should be designed to achieve a rapid room heating with low fuel costs and to have a high heat accumulation capacity for maintaining a heated state for a long time without addition of fuel.

The floor heating system is generally constructed by a wet construction method in which a heat radiator is directly buried in concrete slabs by use of a mortar and a dry construction method in which a heat-insulating material is disposed on concrete slabs and in turn, a heat radiator is mounted in the heat-insulating material.

Floor systems having the above heating system may take the form of a conventional floor system in which the heating system is directly constructed in concrete slabs, or a floating floor system in which the heating system is spaced apart upward from concrete slabs. The floating floor system is also called a double floor structure.

Giving a definition of a floor impact sound in association with the apartment complex, it is a noise being transmitted through floors between dwelling units. The floor impact sound has to be reduced as much as possible, and it has been found that the floating floor system is more advantageous to reduce the floor impact sound than the conventional floor system.

In general, an impact sound generated in a floor passes through a sound-insulating sheet prior to being transmitted to floor slabs. The sound-insulating sheet serves to absorb the impact sound, thereby enabling the insulation of noise. However, conventional sound-insulating sheets have a limit to insulate noise because they should be manufactured in consideration of heating effect in addition to sound insulation effect.

Specifically, increasing the weight of the sound-insulating sheet is advantageous to improve sound insulation effect, but may cause problems of excessively increasing heat-insulation and heating costs. On the other hand, reducing the weight of the sound-insulating sheet is suitable to improve heat insulation effect, but has a problem of deterioration in sound insulation effect.

Further, in the case where the sound-insulating sheet is configured to have a relatively thick thickness for the sake of improving sound insulation effect, there is the risk of rolling of the floor by walking load because of characteristics of the sound-insulating sheet that is made of a flexible material for the absorption of an impact.

Korean Patent Laid-open Publication No. 2004-0071641 discloses a sound-insulating type double floor structure comprising: a plurality of floor supporting panels installed above a base floor at a predetermined height level by use of a group of supporting legs installed through elastic prop members; and a finishing material formed on the supporting panels. The disclosed conventional double floor structure has a feature in that a hardboard or high-density fiberboard having a bending strength of 35~50 ($N/mm^2$), bending young's modulus of 4000~5000 ($N/mm^2$) and density of 0.8~1.2 ($g/cm^3$) is installed between the floor supporting panels and the finishing material. However, it will be appreciated that the conventional double floor structure has no relation with the present invention dealing with a plurality of impact-absorbing materials having different densities from each other.

DISCLOSURE

Technical Problem

Therefore, the present invention has been made in view of the above problems, and it is an object of the present invention to provide a floor system for achieving a remarkable reduction in the transmission of an impact noise between floors of a building.

Technical Solution

In accordance with an aspect of the present invention, the above and other objects can be accomplished by the provision of a floor system comprising: a first impact-absorbing material; and a second impact-absorbing material installed at an upper side of the first impact-absorbing material and having a higher density than that of the first impact-absorbing material.

It is preferable that the density of the second impact-absorbing material be higher than that of the first impact-absorbing material. The greater a density difference between the first and second impact-absorbing materials, the greater the improvement in sound insulation effect of the first and second impact-absorbing materials. However, in consideration of economic efficiency, preferably, the density difference between the first and second impact-absorbing materials may be in a range of 0.5~1.95 $g/cm^3$. As the density difference between the first and second impact-absorbing materials increase, so does the sound-insulation effect increase proportionally. As a result of an experiment performed under the assumption that the density difference is approximately 1.0 $g/cm^3 \pm 0.2$ the first and second impact-absorbing materials showed an improvement in the insulation of heavy sound impacts up to the maximum 3 dB as compared to a conventional single impact-absorbing material.

Preferably, the first impact-absorbing material may have a density in a range of 0.05~0.5 $g/cm^3$. The first impact-absorbing material has to be basically made of a sound-insulating material. As known, a material having an excessively high specific gravity has less impact-absorbing effect and thus, may cause an increase in the transmission of an impact sound. On the other hand, a material having an excessively low specific gravity tends to be compressed by daily life load and thus, similarly may cause an increase in the transmission of an impact sound. In the present invention, the density of the first impact-absorbing material is determined in a range of 0.05~0.5 g/cm$^3$ suitable for improving the floor sound insulation effect.

Preferably, the second impact-absorbing material may have a density in a range of 0.8~2.0 g/cm$^3$ although it is preferable that the density of the second impact-absorbing material is as great as possible. The second impact-absorbing material having a high density can propagate a given impact in a plane direction, thereby preventing the transmission of an impact sound from upstairs to downstairs. Accordingly, it is important for the second impact-absorbing material to have a plate shape having a density in a range of 0.8~2.0 g/cm$^3$, so as to guarantee stability for daily life load.

Preferably, the first impact-absorbing material may be made of foamed plastic, rubber, inorganic material or wood material, and the second impact-absorbing material may be made of wood material or inorganic material having a higher density than that of the first impact-absorbing material.

Preferably, the first impact-absorbing material may have a thickness in a range of 20~30 mm, and the second impact-absorbing material may be 10 mm±5 in consideration of economic efficiency although it is preferable that the thickness of the second impact-absorbing material is as great as possible so long as it is smaller than that of the first impact-absorbing material.

Preferably, the second impact-absorbing material may be divided into a plurality of impact-absorbing materials members arranged parallel to one another in longitudinal and transverse directions, and the neighboring members of the second impact-absorbing material may be connected to one another by using clamps.

Preferably, the first impact-absorbing material may be installed on a floor slab and may have protrusions extending toward the floor slab.

Preferably, the floor system may have a lamination structure of the first impact-absorbing material, the second impact-absorbing material, a heat insulating material, a radiator and a finishing material, which are laminated in this order from the floor slab.

Preferably, the radiator may have a pipe shape or may be plate-shaped panels having inner flow paths.

DESCRIPTION OF DRAWINGS

The above and other objects, features and other advantages of the present invention will be more clearly understood from the following detailed description taken in conjunction with the accompanying drawings, in which.

DESCRIPTION OF REFERENCE NUMERALS TO IMPORTANT PARTS OF THE DRAWINGS

| | |
|---|---|
| 10: finishing material | 13: clamp |
| 30: heat-insulating material | 31: floor slab |
| 32: circular groove | 40: pipe |
| 41: inner space | 51: second impact-absorbing material |
| 60: flooring | 71: first impact-absorbing material |

-continued

| | |
|---|---|
| 71a: protrusion | 130: heat-insulating material |
| 132: panel receiving groove | 140: plate-shaped panel |
| 141: flow path | 142: groove |

BEST MODE

Hereinafter, preferred embodiments of the present invention will be described in detail with reference to the accompanying drawings for an easy understanding of those skilled in the art. It will be appreciated that the present invention is not limited to the following description of the preferred embodiments, and a variety of modifications thereof are possible.

Figure 1:
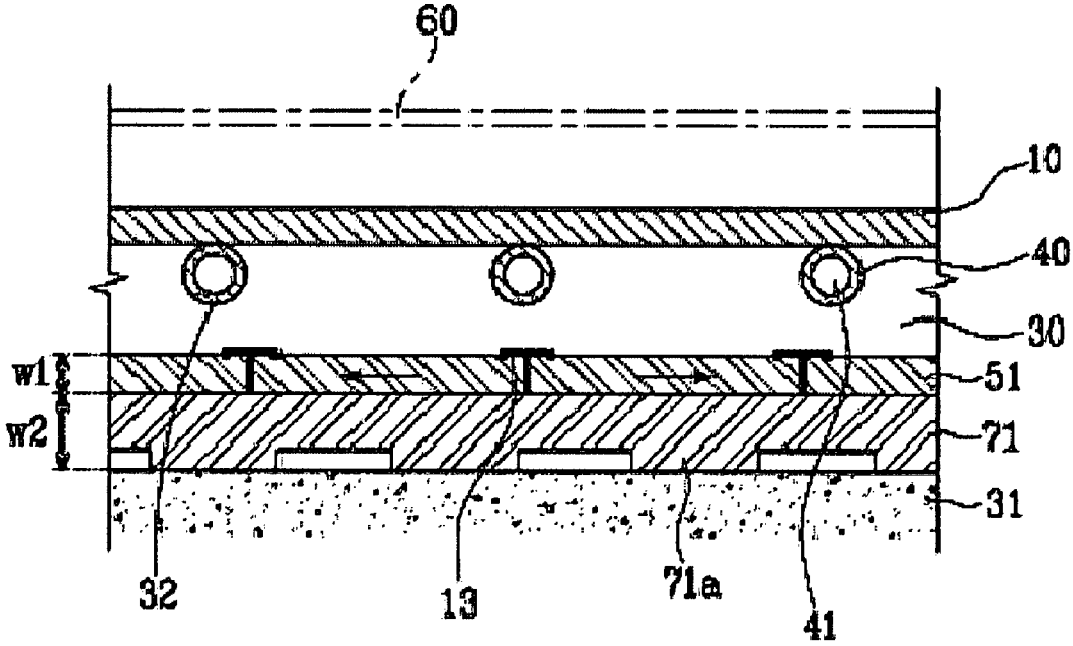
FIG. 1 is a sectional view illustrating a floor system according to a first embodiment of the present invention.
Figure 2:
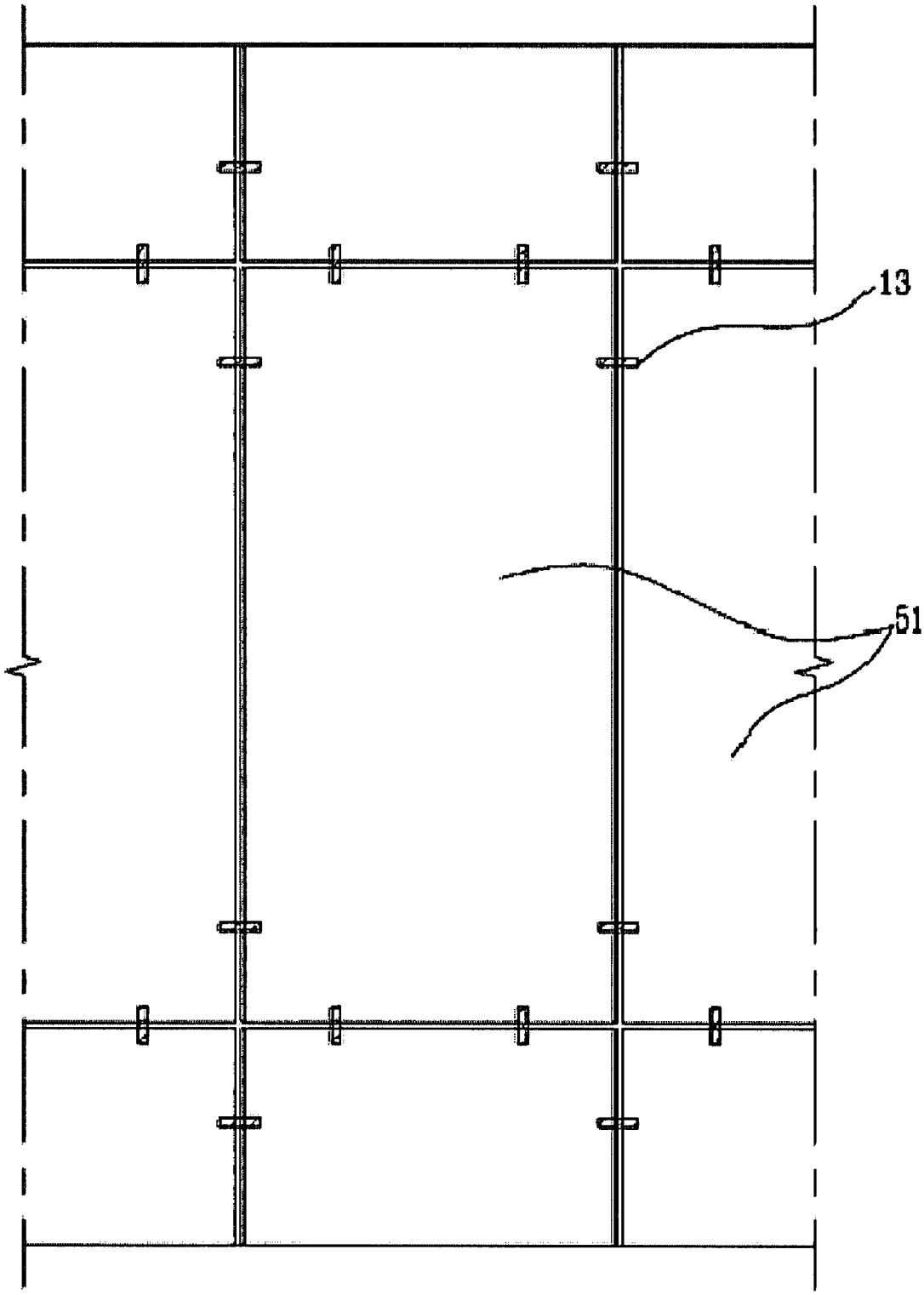
FIG. 2 is a plan view illustrating an impact-absorbing material according to the embodiment of the present invention.

FIG. 1 is a sectional view illustrating a floor system according to a first embodiment of the present invention, and FIG. 2 is a plan view illustrating an impact-absorbing material according to the embodiment of the present invention.

Referring to FIGS. 1 and 2, the floor system according to the first embodiment comprises a first impact-absorbing material 71, a second impact-absorbing material 51, a heat-insulating material 30, a radiator 40 and a finishing material 10.

The first impact-absorbing material 71 is installed on a floor slab 31 and adapted to prevent an upstairs impact sound from being transmitted downstairs. Considering an apartment complex, the floor slab 31 is not only the floor of upstairs, but also the ceiling of downstairs. Accordingly, the floor slab 31 serves as a partition between floors of the apartment complex.

The first impact-absorbing material 71 is used to insulate an impact noise so as not to be emitted to adjacent dwelling units. That is, to prevent the transmission of the impact to the floor slab 31, the first impact-absorbing material 71 may be made of a foamed vinyl-based flooring material or other flexible floor finishing materials such as rubber. Also, the first impact-absorbing material 71 may take the form of an inorganic board, such as a cement board, or a wood board.

The first impact-absorbing material 71 is formed on the floor slab 31 over the entire area of the floor slab 31 to have a thickness w2. The greater the thickness w2 of the first impact-absorbing material 71, the greater the vibration proof performance that the first impact-absorbing material 71 can achieve. However, an excessively thick thickness of the first impact-absorbing material 71 may cause the rolling of the floor by walking load, and therefore, it is preferable to manufacture the first impact-absorbing material 71 within a prescribed thickness range. A preferable thickness of the first impact-absorbing material 71 is in a range of 20~30 mm.

When classifying floor impact sounds into light impact sounds and heavy impact sounds, the first impact-absorbing material 71 is more efficient to prevent the transmission of light impact sounds because the first impact-absorbing material 71 has a lower density than that of the second impact-absorbing material 51. In accordance with a physical theory, a higher density material more efficiently absorbs heavy impact sounds than a lower density material.

The first impact-absorbing material 71 may have a plurality of protrusions 71*a* to more efficiently prevent the transmission of an impact sound to the floor slab 31. The protrusions 71*a* may be formed by vertically protruding certain portions of the first impact-absorbing material 71 downward toward the floor slab 31, or may be formed separately from the first impact-absorbing material 71.

The protrusions 71 a space the first impact-absorbing material 71 apart from the floor slab 31 to prevent the first impact-absorbing material 71 from coming into contact with the floor slab 31, thereby preventing the transmission of an impact sound to the floor slab 31.

The second impact-absorbing material 51 is formed on the first impact-absorbing material 71 over the entire area of the first impact-absorbing material 71 to have a thickness w1. It is generally better to increase the thickness w1 of the second impact-absorbing material 51 so long as it is smaller than that of the first impact-absorbing material 71. Accordingly, in consideration of economic efficiency, the thickness w1 of the second impact-absorbing material 51 is preferably 10±5 mm.

The second impact-absorbing material 51 has a higher density than that of the first impact-absorbing material 71 and is adapted to absorb an impact sound by propagating an impact in a plane direction (designated by the arrows of FIG. 1).

Although it is general that an impact is transmitted in a direction perpendicular to the floor slab 31, causing the transmission of an impact sound downstairs, the second impact-absorbing material 51 acts to propagate the impact in a horizontal plane direction (designated by the arrows of FIG. 1) rather than a vertical direction, thereby being capable of preventing propagation of the impact sound downstairs.

Preferably, the second impact-absorbing material 51 has a higher density than that of the finishing material 10 that is located above the second impact-absorbing material 51.

Generally, the finishing material 10 is made of a flexible material, such as mortar and is thin for the purpose of improving a waterproof performance thereof. For this reason, the finishing material 10 has no function of absorbing an impact, and an impact applied to the finishing material 10 is wholly transmitted to the second impact-absorbing material 51 in a direction perpendicular to the floor slab 31. The impact transmitted to the second impact-absorbing material 51 is dissipated while being propagated in a plane direction. In this case, the density of the second impact-absorbing material 51 has to be higher than that of the finishing material 10, in order to appropriately propagate the impact in a plane direction.

The second impact-absorbing material 51 may take the form of an inorganic board, such as a high-density cement board, or a wood board.

Comparing a cement board with a wood board, the cement board is superior to the wood board in view of a heat-insulation performance, whereas the wood board is superior to the cement board in view of a weight reduction. Also, the inorganic board is superior to the wood board in view of a sound-insulation performance.

The second impact-absorbing material 51 may be constituted by a plurality of members connected to one another. In the present embodiment, as shown in FIG. 2, a plurality of second impact-absorbing material members are continuously arranged in longitudinal and transverse directions parallel to one another. The plurality of second impact-absorbing material members are arranged adjacent to one another and connected by use of clamps 13.

The second impact-absorbing material 51 having the above described configuration is covered, throughout an upper surface thereof, with the heat insulating material 30 and the radiator 40 including pipes is provided thereon.

The heat insulating material 30 serves to prevent unnecessary consumption of heat generated from the pipes 40. The pipes 40, as an example, are XL pipes and serve to emit heat by circulating high-temperature heating water along an inner space 41 of the pipes 40. The pipes 40 are located in an upper portion of the heat insulating material 30 and adapted to emit the majority of heat generated therefrom in a direction opposite to the heat-insulating material 30.

The pipes 40 may be installed on the floor slab 31 in a wet construction or dry construction method. In the case of the wet construction method, the heat-insulating material 30 may be made of a light-weight air-bubble concrete or mortar suitable for encasing the radiator 40. In the case of the dry construction method, the heat-insulating material 30 may be configured to allow the radiator 40 to be assembled thereto.

After the pipes 40 are assembled to the heat-insulating material 30, the finishing material 10 is formed over the pipes 40 and heat-insulating material 30. As stated above, the finishing material 10 may be made of a material having a high waterproof performance, such as mortar, and may have the same composition as that of the second impact-absorbing material 51.

A flooring 60 is spread on the finishing material 10 to form a floor surface of a room. Human activities are performed on the flooring 60.

Figure 3:
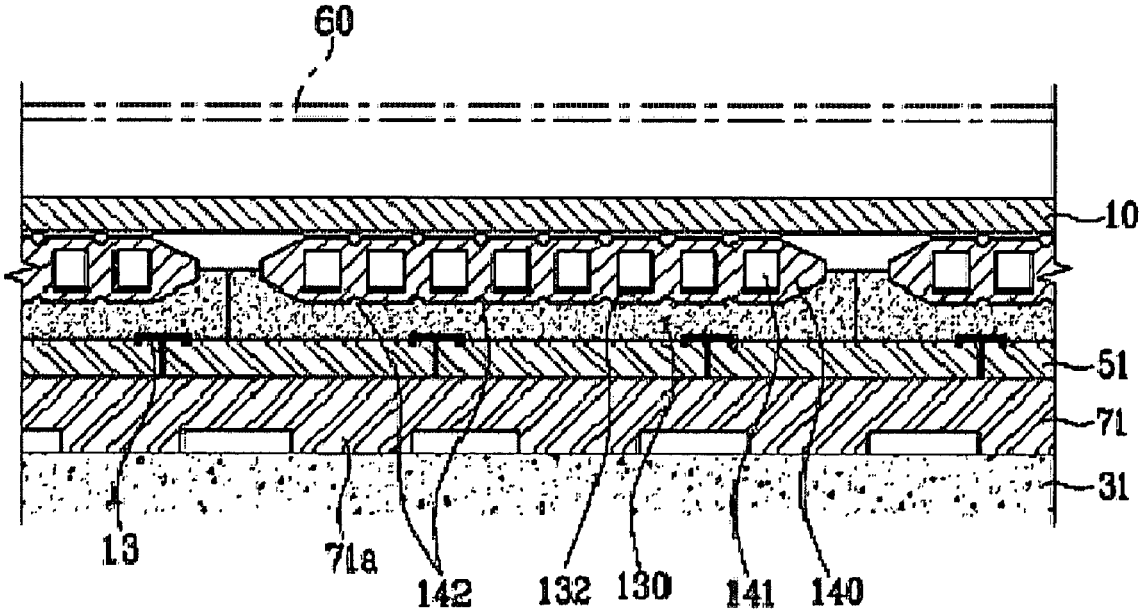
FIG. 3 is a sectional view illustrating a floor system according to a second embodiment of the present invention.

Hereinafter, another floor system that slightly differs from that of the above described first embodiment of the present invention will be explained with reference to FIG. 3. FIG. 3 is a sectional view illustrating the alternative floor system according to the second embodiment.

Comparing the second embodiment with the first embodiment with reference to the drawings, it can be understood that the first and second embodiments have a difference in the configuration of the radiator. The radiator of the first embodiment includes the pipes 40, whereas the second embodiment employs plate-shaped panels 140 as the radiator.

Accordingly, in the second embodiment, a heat-insulating material 130 is formed with a panel receiving groove 132 having a broad width corresponding to the plate-shaped panels 140. In the above described first embodiment, the heat-insulating material 30 is formed with a circular groove 32 corresponding to the pipes 40.

Each of the plate-shaped panels 140 has a plurality of inner flow paths 141 formed therein for the circulation of heating water. Therefore, on the basis of the connecting structure of the flow paths 141, the entire length of the plate-shaped panels 140 can be reduced as compared to the pipes 40 having the single heating water circulating passage 41. This has the effect of reducing operational load of a heating water circulating pump (not shown).

Further, the plate-shaped panels 140 emit heat over an area corresponding to a broad plate shape, and therefore, can realize a heating operation with a more uniform temperature distribution than the pipe-shaped radiator 40. The inner flow paths 41 of the panels 140 may be connected to one another by use of separate connectors (not shown).

The plate-shaped panels 140 are formed at a surface thereof with grooves 142. In a state wherein the plate-shaped panels 140 are installed in the heat-insulating material 130, the plate-shaped panels 140 serve to increase a stationary frictional force with the panel receiving grooves 132 of the heat-insulating material 130 that is affected by the weight of the panels 140.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Example

The floor system as shown in FIG. 1 was prepared. The finishing material 10 was made of an inorganic material having a specific gravity of 1.0 to have a thickness of 10 mm. The heating pipes 40 were cross-linked polyethylene pipes having an outer diameter of 20 mm. The heat-insulating material 30 was made of EPS having a specific gravity of 0.3 and a thickness of 25 mm. The second impact-absorbing material 51 was formed of an inorganic board having a specific gravity of 1.4 and a thickness of 10 mm. The first impact-absorbing material 71 was formed of rubber having a specific gravity of 0.4 and a thickness of 25 mm. As a result of measuring a soundproof performance of the floor system, the floor system showed an improvement of approximately 3 dB as compared to conventional floor systems using a single impact-absorbing material.

INDUSTRIAL APPLICABILITY

As apparent from the above description, the present invention has the effect of efficiently preventing the transmission of an impact sound between floors of an apartment complex.

According to the present invention, first and second impact-absorbing materials having different densities from each other are provided between floor slabs and a finishing material. Therefore, if an impact is generated in a floor, it can be primarily dissipated while being propagated in a plane direction in the second impact-absorbing material, and a light impact sound caused by any residual impact also can be completely removed by the first impact-absorbing material having a lower density than that of the second impact-absorbing material.

Further, according to the present invention, the second impact-absorbing material of the present invention has a higher density than that of the finishing material. Therefore, even if an impact applied to the finishing material is wholly transmitted to the second impact-absorbing material without any reduction, the second impact-absorbing material can remove the impact by propagating the impact sound in a plane direction thereof, thereby preventing transmission of the impact downstairs.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A floor system comprising:

a first impact-absorbing material disposed directly on a floor slab; and a second impact-absorbing material disposed on the first impact-absorbing material and having a higher density than that of the first impact-absorbing material, wherein the second impact-absorbing material is a wood board or an inorganic board having a higher density than that of the first impact-absorbing material by 0.5~1.95 g/cm$^3$, wherein the first impact-absorbing material has a density in a range of 0.05~0.5 g/cm$^3$, and wherein the second impact-absorbing material has a density in a range of 0.8~2.0 g/cm$^3$.

2. The floor system according to claim 1, wherein the first impact-absorbing material is made of foamed plastic or rubber.

3. The floor system according to claim 1, wherein the second impact-absorbing material is divided into a plurality of impact-absorbing material members arranged parallel to one another in longitudinal and transverse directions, and the neighboring members of the second impact-absorbing material are connected to one another by using clamps.

4. The floor system according to claim 1, wherein the first impact-absorbing material has protrusions extending toward the floor slab.

5. The floor system according to claim 4, wherein the protrusions are formed by vertically protruding certain portions of the first impact-absorbing material downward toward the floor slab, or are formed separately from the first impact-absorbing material.

6. The floor system according to claim 1, wherein the system has a lamination structure of the first impact-absorbing material, the second impact-absorbing material, a heat insulating material, a radiator and a finishing material, which are laminated in this order from the floor slab.

7. The floor system according to claim 6, wherein the radiator has a pipe shape.

8. The floor system according to claim 6, wherein the radiator includes plate-shaped panels each having inner flow paths.

9. The floor system according to claim 1, wherein the first impact-absorbing material has a thickness in a range of 20~30 mm, and the second impact-absorbing material has a thickness of 10 mm±5.

* * * * *